US012484757B2

(12) United States Patent
Czarnecki et al.

(10) Patent No.: US 12,484,757 B2
(45) Date of Patent: Dec. 2, 2025

(54) FIXED AIR KNIFE FOR A DISHWASHER

(71) Applicant: WHIRLPOOL CORPORATION, Benton Harbor, MI (US)

(72) Inventors: Philip J. Czarnecki, Saugatuck, MI (US); Mark S. Feddema, Kalamazoo, MI (US); Stephanie Camazzola Godoshian, St. Joseph, MI (US); Gautam Prakash Kamat, St. Joseph, MI (US); Vilas D. Raut, Pune (IN); Annie M. Stuart, Kalamazoo, MI (US); Akshay S. Tondwal, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 68 days.

(21) Appl. No.: 18/420,351

(22) Filed: Jan. 23, 2024

(65) Prior Publication Data

US 2025/0235075 A1 Jul. 24, 2025

(51) Int. Cl.

| | |
|---|---|
| ***A47L 15/48*** | (2006.01) |
| ***A47L 15/00*** | (2006.01) |
| ***A47L 15/42*** | (2006.01) |
| ***A47L 15/46*** | (2006.01) |
| ***A47L 15/50*** | (2006.01) |

(52) U.S. Cl.

CPC ..... *A47L 15/486* (2013.01); *A47L 15/0034* (2013.01); *A47L 15/4246* (2013.01); *A47L 15/4293* (2013.01); *A47L 15/46* (2013.01); *A47L 15/507* (2013.01); *A47L 2501/12* (2013.01); *A47L 2501/26* (2013.01); *A47L 2501/30* (2013.01)

(58) Field of Classification Search

CPC ..... A47L 15/486

See application file for complete search history.

(56) References Cited

U.S. PATENT DOCUMENTS

| | | | |
|---|---|---|---|
| 6,053,185 | A | 4/2000 | Beevers |
| 8,226,778 | B2 | 7/2012 | Kramer |
| 9,888,829 | B1 | 2/2018 | Bongivengo |
| 10,524,634 | B2 | 1/2020 | Digman |
| 10,980,395 | B2 | 4/2021 | Kim et al. |
| 11,241,140 | B2 | 2/2022 | Jung et al. |

(Continued)

FOREIGN PATENT DOCUMENTS

| | | | |
|---|---|---|---|
| CN | 110897573 | A | 3/2020 |
| DE | 102021100944 | A1 | 7/2022 |

(Continued)

*Primary Examiner* — Jason Y Ko

(74) *Attorney, Agent, or Firm* — Price Heneveld LLP

(57) ABSTRACT

A dishwasher includes a tub having a top wall extending between opposing side walls. The tub defines a washing chamber. A dishrack operable between a stowed state within the washing chamber and a deployed state extending at least partially out of the washing chamber. An air drying system is coupled to the tub and includes a housing coupled to the top wall of the tub. The housing extends into the washing chamber proximate the dishrack and defines an air inlet. An air knife coupled to the housing and extending along a width of the washing chamber proximate to the top wall of the tub. The air knife defines a slit. A blower operably coupled to the air knife is configured to draw air through the air inlet and direct the air through the slit of the air knife to generate an air curtain across the width of the washing chamber.

20 Claims, 9 Drawing Sheets

(56) References Cited

U.S. PATENT DOCUMENTS

| | | | |
|---|---|---|---|
| 11,246,469 | B2 | 2/2022 | Jung et al. |
| 11,672,404 | B2 | 6/2023 | Wolowicz et al. |
| 11,800,963 | B2 | 10/2023 | Digman et al. |
| 11,819,175 | B2 | 11/2023 | Ang |
| 11,825,998 | B2 | 11/2023 | Lutz et al. |
| 2019/0053686 | A1 | 2/2019 | Weigle |
| 2022/0296075 | A1 | 9/2022 | Stickel et al. |
| 2023/0292984 | A1 | 9/2023 | Almus et al. |

FOREIGN PATENT DOCUMENTS

| | | | |
|---|---|---|---|
| DE | 102015013364 | B4 | 5/2023 |
| EP | 3797668 | B1 | 5/2022 |
| EP | 3998009 | B1 | 3/2023 |
| JP | H08215128 | A | 8/1996 |
| JP | 2894545 | B2 | 5/1999 |
| KR | 101202103 | B1 | 11/2012 |

FIXED AIR KNIFE FOR A DISHWASHER

BACKGROUND OF THE DISCLOSURE

The present disclosure generally relates to an air knife drying assembly, and more specifically, to a fixed air knife for a dishwashing appliance.

SUMMARY OF THE DISCLOSURE

According to one aspect of the present disclosure, a dishwasher includes a tub having a top wall that extends between first and second opposing side walls. The tub defines a washing chamber. Guide members are coupled to the first and second opposing side walls of the tub. A dishrack is supported by the guide members, wherein the dishrack is operable between a stowed state within the washing chamber and a deployed state at least partially extending out of the washing chamber. An air drying system is coupled to the tub. The air drying system includes a housing defining an air inlet, where the housing is coupled to the top wall of the tub and extends into the washing chamber proximate to the dishrack. An air knife is coupled to the housing and extends along a width of the washing chamber proximate to the top wall. The air knife defines a central opening and an air outlet. A blower is disposed in the housing. The blower is configured to direct air through the air outlet of the air knife to generate an air curtain across the width of the washing chamber. The dishrack is configured to move through the air curtain as the upper dishrack moves between the stowed state and the deployed state to reduce liquid on dishes on the dishrack. The air curtain is angled toward an interior of the washing chamber to reduce or prevent splash from exiting the dishwasher.

According to another aspect of the present disclosure, a dishwasher includes a tub having a top wall. The tub defines a front opening and a washing chamber. A dishrack is disposed in the washing chamber. The dishrack is operable between a stowed state and a deployed state. An air drying system is coupled to the tub. The air drying system includes a housing coupled to the top wall of the tub. The housing includes an internal portion within the washing chamber and an external portion outside of the washing chamber. An air knife is coupled to the housing. The air knife includes an air outlet. A blower is configured to direct air through the air knife to form a fan-shaped air curtain that is directed toward a bottom of the washing chamber as the dishrack moves between the stowed and deployed states.

According to yet another aspect of the present disclosure, a dishwasher includes a tub having a top wall extending between opposing side walls. The tub defines a washing chamber. A dishrack is operable between a stowed state within the washing chamber and a deployed state extending at least partially out of the washing chamber. An air drying system is coupled to the tub. The air drying system includes a housing coupled to the top wall of the tub and extending into the washing chamber proximate to the dishrack. The housing defines an air inlet. An air knife is coupled to the housing and extends along a width of the washing chamber proximate to the top wall of the tub. The air knife defines a slit. A blower is operably coupled to the air knife. The blower is configured to draw air through the air inlet and direct the air through the slit of the air knife to generate an air curtain across the width of the washing chamber.

These and other features, advantages, and objects of the present disclosure will be further understood and appreciated by those skilled in the art by reference to the following specification, claims, and appended drawings.

Figure 1:
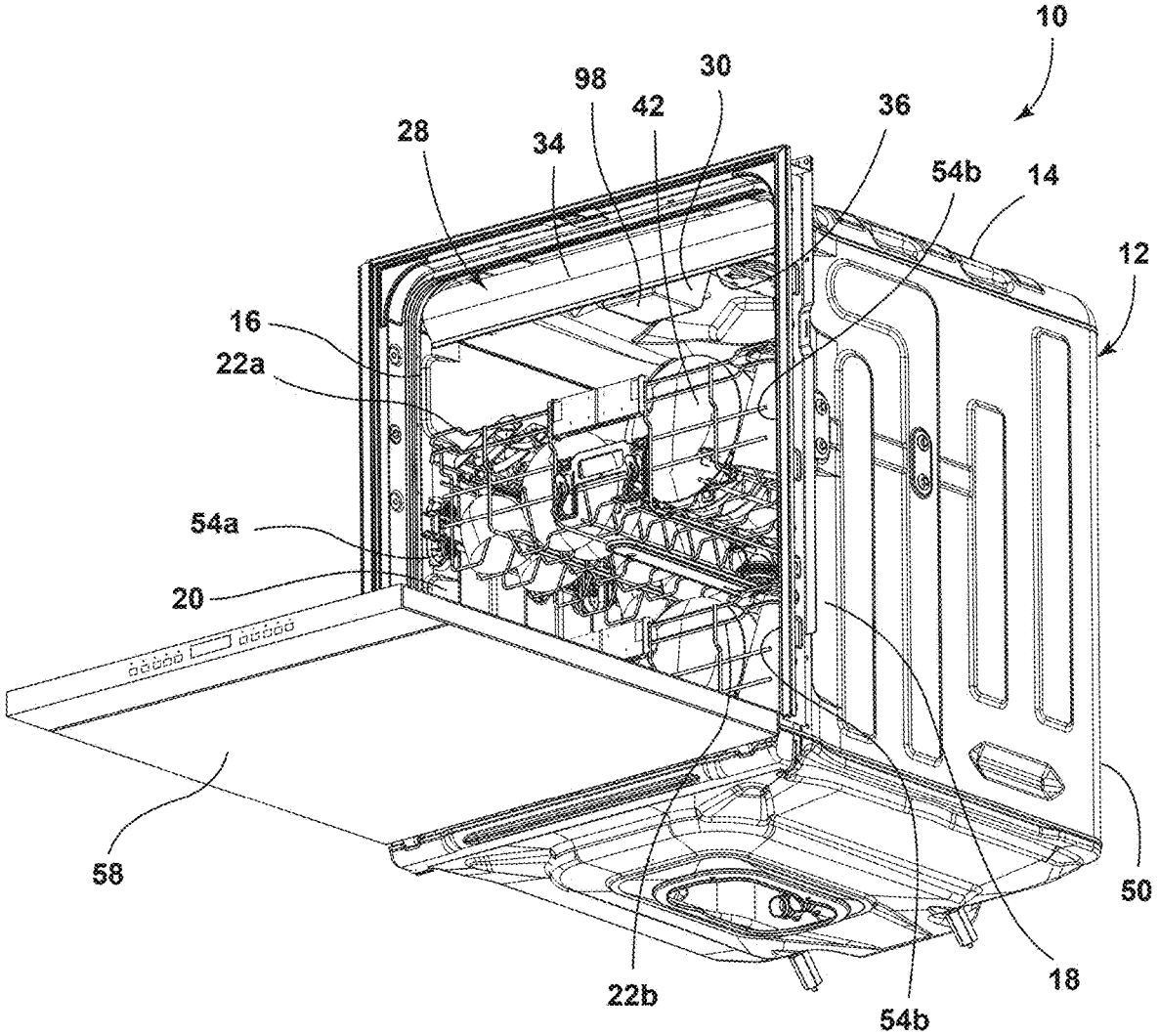
FIG. 1 is a side perspective view of an air drying system within a washing chamber of a dishwashing appliance, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a fixed air knife for a dishwasher. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-11, reference numeral 10 generally designates a dishwashing appliance or a dishwasher 10. The dishwasher 10 includes a tub 12 having a top wall 14 extending between opposing side walls 16, 18 that at least partially define a washing chamber 20. An upper dishrack 22*a* and a lower dishrack 22*b* are disposed in the washing chamber 20 and are each operable between a stowed state 24 within the washing chamber 20 and a deployed state 26 at least partially extending out of the washing chamber 20. An air drying system 28, also referred to as a drying system 28, is coupled to the tub 12. The air drying system 28 includes a housing 30 coupled to the top wall 14 of the tub 12 and that extends into the washing chamber 20 proximate the upper dishrack 22*a*. The housing 30 defines an air inlet 32. An air knife 34 is coupled to the housing 30 and extends along a width of the washing chamber 20 proximate the top wall 14 of the tub 12. The air knife 34 defines an air outlet 36. A blower 38 is disposed in the housing 30 and is configured to direct air through the air outlet 36 of the air knife 34 to generate an air curtain 40 across the width of the washing chamber 20. The upper dishrack 22*a* is configured to move through the air curtain 40 as the upper dishrack 22*a* moves between the stowed state 24 and the deployed state 26 to reduce liquid on dishes 42 disposed in the upper dishrack 22*a*.

Referring to FIG. 1, the dishwasher 10 includes the tub 12 which defines the washing chamber 20 in which the dishes 42 can be placed to be washed and dried. The tub 12 defines a front opening 46 for accessing the washing chamber 20. Additionally, the tub 12 includes the opposing side walls 16, 18 and a rear wall 50, which extends between the opposing side walls 16, 18 and is opposite the front opening 46. The top wall 14 of the tub 12 connects the opposing side walls 16, 18 and the rear wall 50 to define the washing chamber 20.

Guide members 54*a*, 54*b* are coupled to the sidewalls 16, 18, respectively, to support the upper dishrack 22*a* and the lower dishrack 22*b*. In this way, the dishwasher 10 includes a set of upper guide members 54*a*, 54*b* to support the upper dishrack 22*a* and a set of lower guide members 54*a*, 54*b* to support the lower dishrack 22*b*. The upper and lower dishracks 22*a*, 22*b* are movable along the guide members 54*a*, 54*b* to be positioned in the washing chamber 20 when in the stowed state 24 and for extending out of the washing chamber 20 when in the deployed state 26.

A door 58 is rotatably coupled to the tub 12. The door 58 is operable between an opened position to access the washing chamber 20 via the front opening 46 of the tub 12 and a closed position to enclose the washing chamber 20. In certain aspects, the door 58 may be manually adjusted by a user between the opened and closed positions. When the door 58 is in the opened position, the user may move and adjust the upper and lower dishracks 22*a*, 22*b* to extend beyond the front opening 46 of the tub 12.

During operation, the dishwasher 10 proceeds through various cycles to clean and dry the dishes 42 including at least one wash cycle and at least one dry cycle. The dishwasher 10 contains a first spray bar 64 (see FIGS. 9A-9C) disposed proximate the top wall 14 of the tub 12 in the washing chamber 20. The first spray bar 64 directs water downward through a plurality of nozzles onto the dishes 42. In certain aspects, the first spray bar 64 is configured to continuously rotate for a predetermined length of time during at least one of the wash cycles to maximize an area where the first spray bar 64 directs washing fluid. The first spray bar 64 generally provides water coverage for the dishes 42 disposed in the upper dishrack 22*a*.

Additionally or alternatively, a second spray bar may be included proximate the lower dishrack 22*b* to direct water upward through a plurality of nozzles onto the dishes 42 on the lower dishrack 22*b*. The use of the first spray bar 64 and the second spray bar can assist with maximizing the area where the washing fluid is sprayed over the dishes 42. The dishwasher 10 may include additional spray bars without departing from the teaching herein. Further, additional components may be included in the dishwasher 10 to generate or direct washing fluids in the dishwasher 10, where the washing fluid can include water and/or cleaning solution.

Heating elements may be located in one or more locations throughout the tub 12 of the dishwasher 10 to provide heat to assist in the removal of excess liquid, such as water and/or cleaning solution, or moisture remaining on the dishes 42 after completion of at least one of the wash cycles (e.g., during a dry cycle). In certain aspects, the heating elements may include a heating element that can heat the water, which may be referred to as an integrated heater. Additionally or alternatively, the heating element can heat both the water and the air within the washing chamber 20, which may be referred to as a calrod heater. Further, the dishwasher 10 can include pumps for removing water, fluid, and/or moisture from the tub 12 during a dry cycle. Moreover, the dishwasher 10 may include a fan to assist the drying process.

Referring still to FIG. 1, the dishwasher 10 may perform one or more cycles to clean and dry the dishes 42 including, but not limited to, a pre-wash fill cycle, a main wash cycle, one or more rinse cycles, a drying cycle, and a dry assist cycle. Detergent is dispensed or otherwise introduced into the tub 12 during the main wash cycle and circulated by the first spray bar 64 and/or the second spray bar to wash the dishes 42 in the upper and lower dishracks 22*a*, 22*b*. The transitions between, and order of, the dishwashing cycles are generally controlled electronically at certain points of the various cycles based on set programs and/or feedback from a sensor 70 via a control system of the dishwasher 10 including a controller 74 (see FIG. 8).

The dishwasher 10 includes a user interface 78, which may include a display 82 (see FIG. 8) or other interactive components, that can be positioned on or above the door 58. The user interface 78 provides the user with various options, including selecting and initiating various dishwashing processes. Additionally, the user may initiate any of the wash and dry cycles in isolation by engaging with the user interface 78. Generally, the air drying system 28 undergoes the dry assist cycle upon completion of the dishwashing process, including the various washing and drying cycles as described herein. In this way, the dry assist cycle can be an end or final drying process. In certain aspects, the dry assist cycle may be manually selected by the user via the user interface 78. However, the air drying system 28 may undergo an automatic dry assist cycle upon completion of the dishwashing process. Further, the dry assist cycle may be performed in isolation or at other times relative to other cycles of the dishwasher 10 without departing from the teachings herein.

Figure 2:
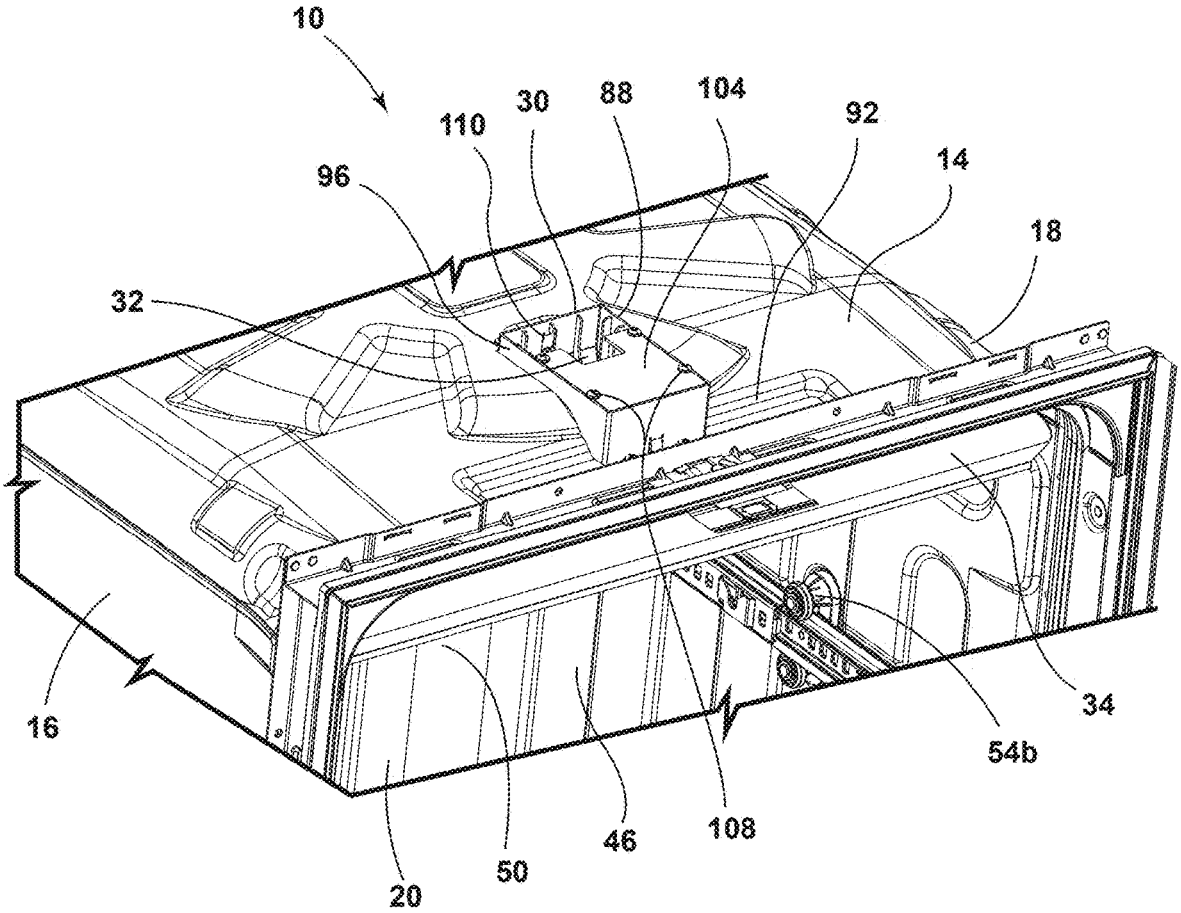
FIG. 2 is a side perspective view of an external portion of a housing coupled to a tub of a dishwashing appliance, according to the present disclosure.
Figure 3:
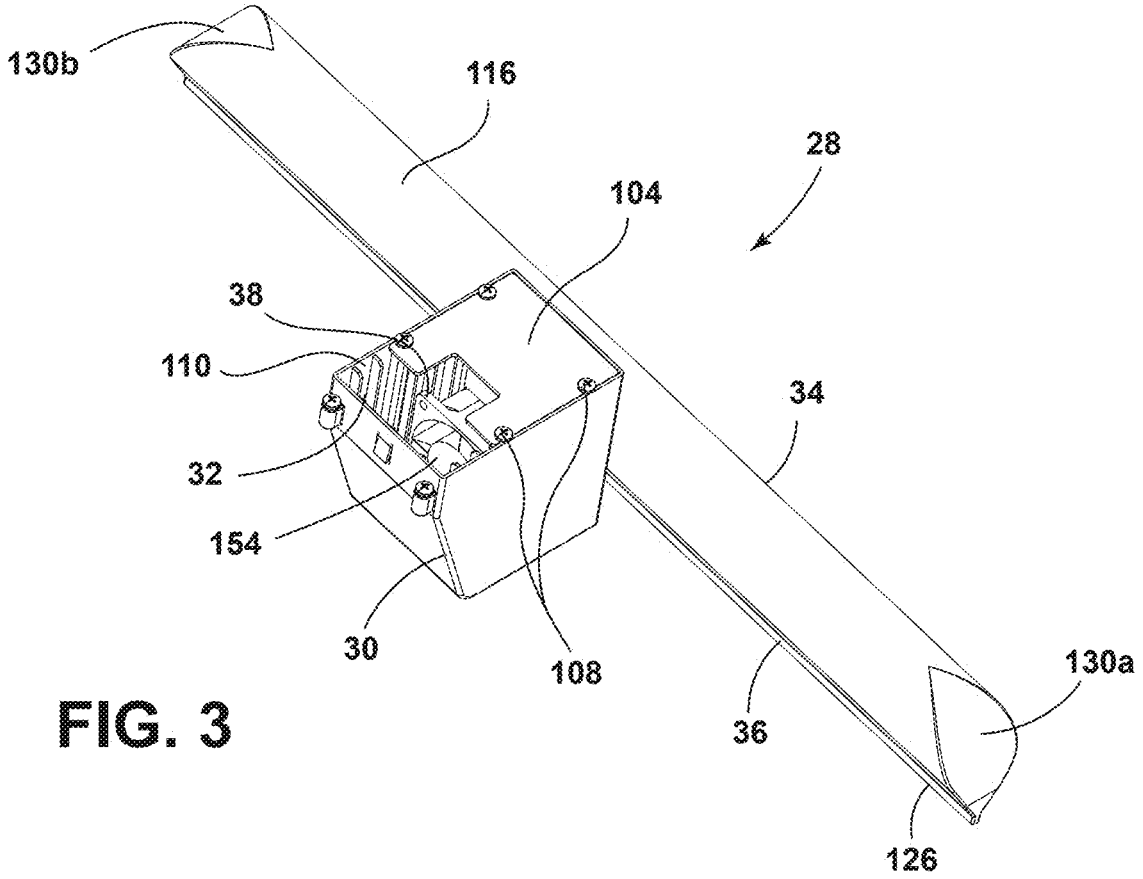
FIG. 3 is a side perspective view of an air drying system for a dishwashing appliance, according to the present disclosure.
Figure 4:
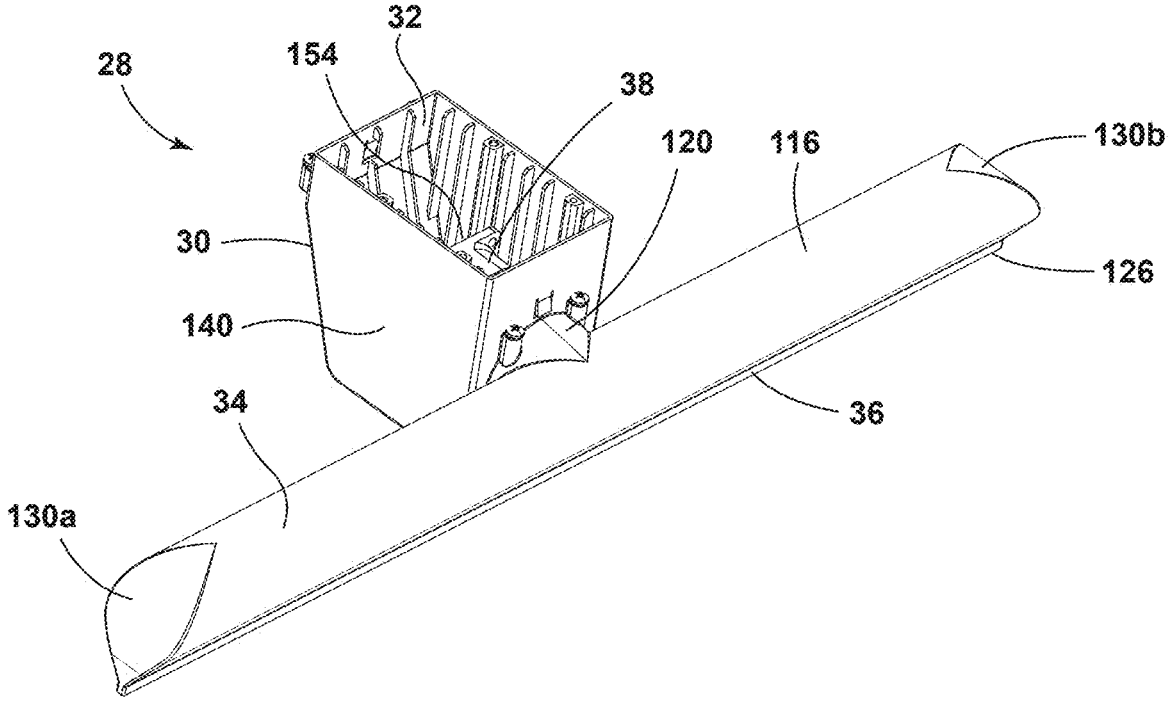
FIG. 4 is a side perspective view of an air drying system for a dishwashing appliance with a cover removed, according to the present disclosure.
Figure 5:
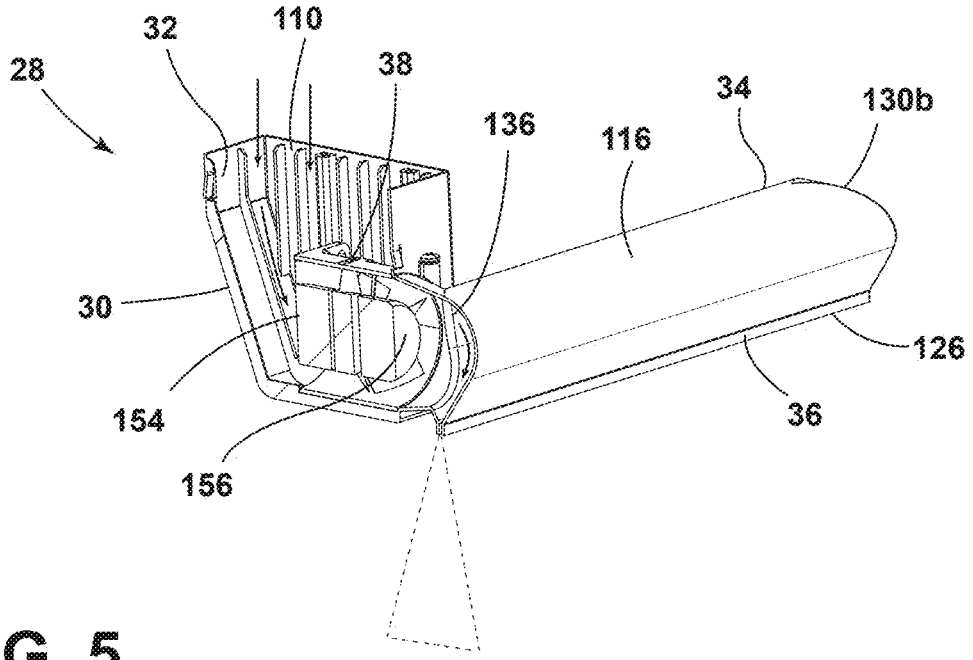
FIG. 5 is a side perspective cross-sectional view of an air drying system with a blower, according to the present disclosure.
Figure 6:
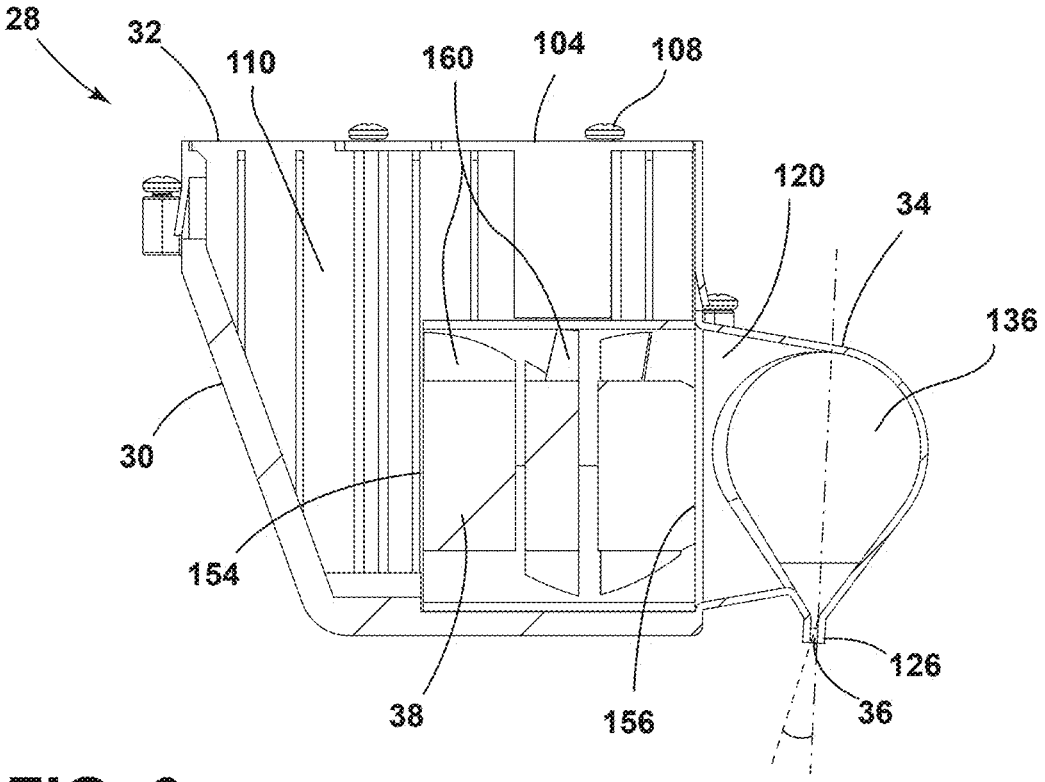
FIG. 6 is a cross-sectional view of an air drying system with a blower disposed in a housing, according to the present disclosure.

Referring to FIG. 2, the top wall 14 of the tub 12 defines an opening 88. As illustrated, the opening 88 is centrally located along a front portion 92 of the top wall 14 of the tub 12 (i.e., proximate the front opening 46) and generally equidistant from the opposing sidewalls 16, 18. Further, the opening 88 is generally defined in a front location relative to the depth of the washing chamber 20 to align the air knife 34 adjacent to or along a substantial portion, or an entirety, of a width of the front opening 46, however, the opening 88 may be disposed in other locations without departing from the teachings herein. Additionally, the opening 88 provides fluid communication between the washing chamber 20 and an exterior of the tub 12.

Referring to still to FIGS. 1 and 2, as well as FIGS. 3-6, the housing 30 is disposed in the opening 88 of the tub 12 and generally fills the opening 88. The housing 30 extends through the top wall 14 of the tub 12 and into the washing chamber 20. Accordingly, the housing 30 includes an external portion 96 outside of the washing chamber 20 and an internal portion 98 within the washing chamber 20. The internal portion 98 and the external portion 96 define an interior cavity 110 of the housing 30, which extends from an area external to the tub 12 to the washing chamber 20.

A cover 104 is coupled to the external portion 96 via a plurality of fasteners 108. The cover 104 partially overlays an open end of the external portion 96 of the housing 30, leaving a section of the open end open and uncovered to define the air inlet 32. The air inlet 32 is a cutout section of the housing 30 that is not engaged with or blocked by the cover 104 and provides a space for the air to be drawn through the air drying system 28. The air inlet 32 is defined outside of the washing chamber 20, generally above the top wall 14 of the tub 12. This configuration allows the air drying system 28 to use external or ambient air for the air curtain 40. However, it is contemplated that the housing 30 may define the air inlet 32 in a different location, such as within the washing chamber 20 to recirculate air from the washing chamber 20 as the air curtain 40 without departing from the teachings herein.

The internal portion 98 of the housing 30 extends through the opening 88 of the top wall 14 of the tub 12 to be positioned within the washing chamber 20. The internal portion 98 of the housing 30 is generally a cuboid-shaped structure that includes an angled wall that aligns with and is coupled to the top wall 14 of the tub 12 to facilitate airflow through the interior cavity 110 and, ultimately, into the washing chamber 20. Further, the housing 30 may include ribs extending along an interior surface thereof. The ribs may extend from the open end toward a bottom of the housing 30 proximate to the blower 38 to assist in directing the airflow through the housing 30.

Referring still to FIGS. 1-7, the air drying system 28 includes the air knife 34 coupled to the housing 30, which may collectively be referred to as an air drying assembly. The air knife 34 is configured to direct the air curtain 40 towards the dishes 42 disposed in the upper and/or lower dishracks 22*a*, 22*b*. The air knife 34 includes an elongated body 116 that extends between the opposing sidewalls 16, 18 of the tub 12 within a front portion of the washing chamber 20 proximate the front opening 46. In this way, the air knife 34 extends along a substantial portion, or an entirety, of a front of the top wall 14 and the tub 12, while allowing the door 58 to open and close with minimal or no interference from the air knife 34.

The elongated body 116 of the air knife 34 defines a central opening 120 in fluid communication with the blower 38. Air drawn through the air drying system 28 from the air inlet 32 is directed through the central opening 120 of the air knife 34, providing fluid communication between the housing 30 and the air knife 34. The blower 38 and the central opening 120 are arranged in a central location along the width of the tub 12. In this way, the air knife 34 extends in opposing directions from the blower 38 along the width of the washing chamber 20 proximate the front opening 46.

The elongated body 116 also defines a slit 126 forming the air outlet 36 of the air knife 34. The slit 126 extends across the width of the washing chamber 20 to form an elongated air outlet 36 for forming the air curtain 40. The slit 126 forming the air outlet 36 extends between rounded ends 130*a*, 130*b* of the elongated body 116 of the air knife 34. Accordingly, the slit 126 is a generally elongated, narrow, nozzle-like opening with a depth less than about 2 mm, for example between about 1.3 mm and about 1.7 mm, that enables the air within an internal air passage 136 of the elongated body 116 of the air knife 34 to form a more uniform, pressurized air curtain 40.

Further, the slit 126 allows the air curtain 40 to be fan-shaped along the width of the tub 12. Accordingly, when the air drying system 28 is activated, the nozzle-like configuration of the slit 126 facilitates directed airflow to produce a high-velocity air curtain 40 capable of removing excess liquid and moisture on the dishes 42 disposed in the upper dishrack 22*a*.

In certain aspects, the slit 126 may be formed for the air outlet 36 to direct the air curtain 40 vertically downward. In additional or alternative aspects, the elongated body 116 of the air knife 34 is tilted inwardly towards the washing chamber 20 at an acute angle, generally between about 2° and about 3° (relative to vertical) 0°, to direct the air curtain 40 slightly toward the washing chamber 20 to assist in retaining excess moisture and liquid within the washing chamber 20 when the air curtain 40 is directing pressurized air along the dishes 42 (see FIG. 6). In additional non-limiting aspects, the slit 126 of the elongated body 116 of the air knife 34 is configured to tilt inwardly towards the washing chamber 20 at the acute angle between about 2° and about 3° to assist in excess moisture and water retention when the air drying system 28 is activated. In such examples, the slit 126 may be tilted while at least a portion of the elongated body 116 may not be tilted.

The tilted configuration generating the inwardly directed air curtain 40 assists with retaining water or liquid from the dishes 42 within the washing chamber 20. For example, the air curtain 40 engaging residual pools of water on dishes 42 may cause the water to splash or otherwise move out of the dishes 42. The air curtain 40 is angled inwardly toward an interior of the washing chamber 20 and/or the rear wall 50 to assist in retaining the splashes within the washing chamber 20 and reducing or preventing the splash of liquid from exiting the dishwasher.

Additionally, the elongated body 116 generally has a narrow "teardrop" cross-sectional geometry and includes the rounded ends 130*a*, 130*b* that enclose the internal air passage 136 of the air knife 34. The "teardrop" geometry of the elongated body 116 assists in transferring the air from the internal air passage 136, with a reduction of internal turbulence, into the pressurized flow of air provided by the air curtain 40 in a downward direction toward the dishes 42 disposed in the upper dishrack 22*a* when the air drying system 28 is activated.

Referring still to FIGS. 1-7, the position of the central opening 120 relative to the elongated body 116 provides a central entry for the air directed by the blower 38 into the internal air passage 136. Accordingly, the central opening 120 provides fluid communication between the housing 30 and the elongated body 116. The air is directed through the central opening 120 and then in opposing directions along the length of the elongated body 116 to or toward the rounded ends 130*a*, 130*b*. In other words, the position of the central opening 120, along with the position of the blower 38 and the housing 30, assists with more efficiently and more evenly directing air along the full length/width of the air knife 34 and, consequently, to the width of the upper dishrack 22*a*.

The rounded ends 130*a*, 130*b* of the elongated body 116 of the air knife 34 provide more efficient coverage of airflow over a substantial or full depth and width of the upper dishrack 22*a* when the upper dishrack 22*a* is in the deployed state 26. As air is directed through the elongated body 116 of the air knife 34, the air is dynamically compressed through the smoothly tapered inner profile of the elongated body 116 to achieve the air curtain 40.

Referring still to FIGS. 3-6, the air drying system 28 also includes the blower 38 disposed within the internal portion 98 of the housing 30. The blower 38 includes a proximal end 154 proximate the air inlet 32 and a distal end 156 proximate the central opening 120 of the air knife 34. During the dry assist cycle, air from an exterior area outside of the external portion 96 of the housing 30 is drawn through the air inlet 32 towards the proximal end 154 of the blower 38 and further past the distal end 156.

When the air drying system 28 is activated, blades 160 of the blower 38 direct air through the central opening 120 of the air knife 34 and into the internal air passage 136 of the elongated body 116. Accordingly, the air is directed through the air knife 34 and is then directed in a generally downward direction, through the slit 126, towards a bottom of the washing chamber 20 to form the air curtain 40, as described herein. Additionally, the area of the air inlet 32 is larger than the diameter of the blower 38. This configuration optimizes airflow and reduces restrictions on the airflow into the air drying system 28. The enlarged air inlet 32, relative to the diameter of the blower 38, allows air to flow into the interior cavity 110 with reduced obstruction.

Referring again to FIG. 7, the configuration of the air drying assembly 28, including the "teardrop" shape of the elongated body 116 and the slit 126, forms the air curtain 40 from the air being directed by the blower 38. The air curtain 40 creates a flat, sheet-like air jet profile extending across the length and width/depth of the slit 126 defining the air outlet 36 and, consequently, the width of the front opening 46. The air curtain 40 transfers pressurized air to residual pools of liquid or excess moisture on the dishes 42 via fluid shearing actions, thereby displacing moisture on the dishes 42 under optimized laminar flow conditions inside the air knife 34.

Figure 7:
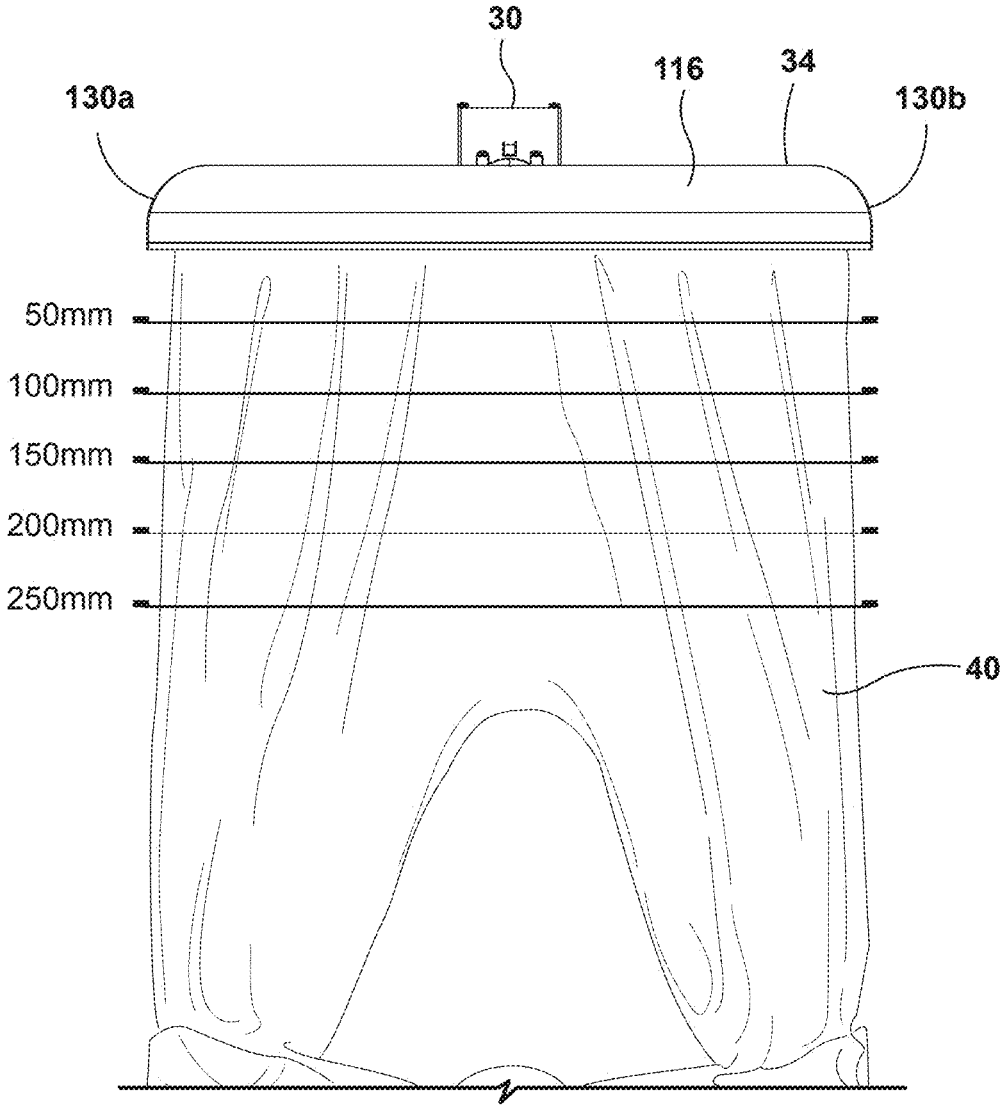
FIG. 7 is an illustrative view of an air curtain directed downward from an air outlet of an air delivery system, according to the present disclosure.

Referring still to FIG. 7, the air outlet 36 of the air knife 34 is generally positioned between about 200 mm and about 250 mm from the dishes 42 of the upper dishrack 22*a*, and forms an air curtain 40 where air is directed toward the dishes 46 at a velocity between approximately 5 m/s and approximately 12 m/s. This velocity provides for efficient liquid and excess moisture removal while reducing movement of or damage to the dishes 42 due to excessive pressurized airflow. In this way, as illustrated in FIG. 7, the air forming the air curtain 40 moves at a velocity between about 5 m/s and 12 m/s at the air outlet 36 and at a distance of between at least about 200 mm and about 250 mm from the air outlet 36.

Referring again to FIGS. 1-7, the pressurized air supply generated by the blower 38 is directed into the central opening 120 of the air knife 34. The forced air enters the internal air passage 136 of the elongated body 116 and is accelerated through the slit 126 defining the air outlet 36 of the air knife 34 to create the air curtain 40. When the air drying system 28 is activated, the blower 38 directs the air through the air outlet 36 of the air knife 34 in a downward direction to form the air curtain 40 that extends a substantial length of the upper dishrack 22*a* and the tub 12, extending from a proximate first side end of the upper dishrack 22*a* to a proximate second side end of the upper dishrack 22*a*. The air curtain 40 extends between the opposing first and second ends of the upper dishrack 22*a* to provide coverage along a substantial or entire width of the upper dishrack 22*a*, as well as a substantial or entire depth as the upper dishrack 22*a* is moved relative to the air knife 34. The air from the air curtain 40 is directed along a full length/width of the air knife 34 and is evenly distributed along the air knife 34 due to the location of the central opening 120 and the shape of the rounded ends 130*a*, 130*b*.

Figure 8:
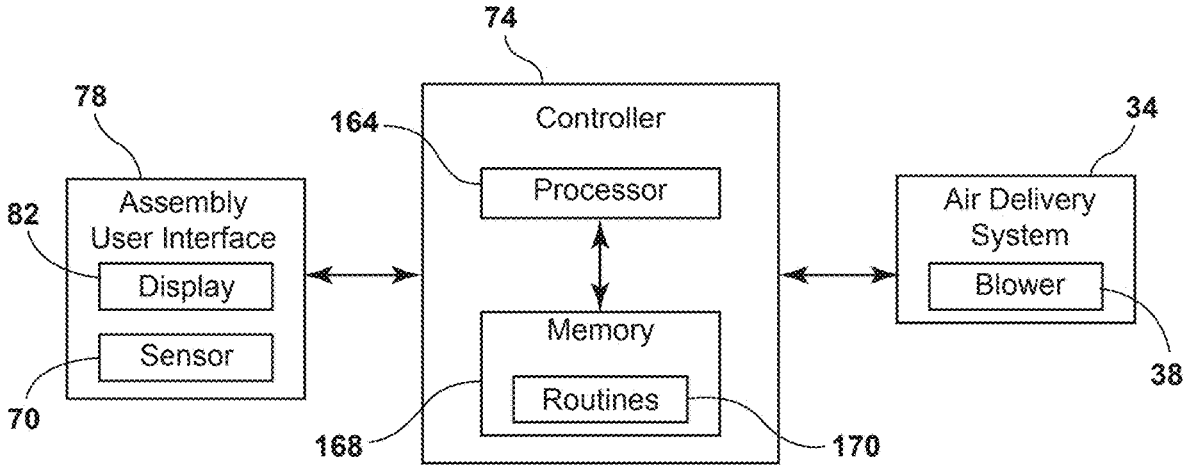
FIG. 8 is a block diagram of a dishwashing appliance with an air delivery system, according to the present disclosure.

Referring to FIG. 8, the dishwasher 10 includes the controller 74 having a processor 164, a memory 168, and other control circuitry. Instructions or routines 170 are stored in the memory 168 and executable by the processor 164. The routines 170 can generally be related to operation of the dishwasher 10 (e.g., washing systems, drying systems, draining systems, etc.), as well as operation of the air drying system 28. For example, the controller 74 is configured to notify the user that the dishwashing process, including the various wash and dry cycles, is complete thereby allowing the user to manually initiate the dry assist cycle of the air drying system 28. In certain aspects, the controller 74 is configured to automatically start the dry assist cycle for the air drying system 28 upon completion of the various wash cycles and dry cycles.

The controller 74, in response to the completion of the dishwashing process, is configured to generate and output/communicate a notification to the user via the user interface 78 (e.g., via the display 82), notifying the user that the dry assist cycle is selectable. Generally, the air drying system 28 is configured to be manually initiated by the user via the user interface 78. In response to a user selection received from the user interface 78, the controller 74 is configured to send an activation signal to the air drying system 28 to start the dry assist cycle in order to substantially dry the dishes 42.

In various examples, the controller 74 is configured to output the notification indicating the completion of the various wash and dry cycles of the dishwashing process via the display 82 of the user interface 78. The notification can be at least one of an audible, haptic, or visual notification in response to the completion of the dishwashing process(es).

The user may then select an activation feature on the user interface 78 to manually initiate the dry assist cycle, activating the blower 38 of the air drying system 28. The controller 74 may be configured to maintain the air drying system 28 in an active state for a predefined length of time, or the user may select a feature on the user interface 78 to deactivate the air drying system 28. In certain aspects, the air drying system 28 may be automatically activated in response to the sensor 70 detecting a gesture, such as by a hand, by the user below the air drying system 28, or a gesture generally within the washing chamber 20. In other certain aspects, the air drying system 28 may be automatically activated in response to the sensor 70 detecting movement of the upper or lower dishrack 22*a*, 22*b* and/or the door 58.

Figure 9A:
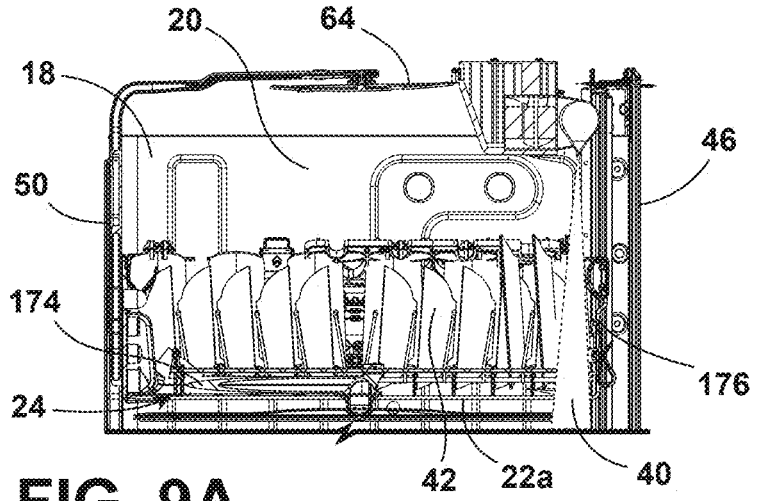
FIG. 9A is a partial cross-sectional view of a tub with an upper dishrack in a stowed state and with an air curtain illustrated directing air in a downward direction toward the upper dishrack, according to the present disclosure.
Figure 9B:
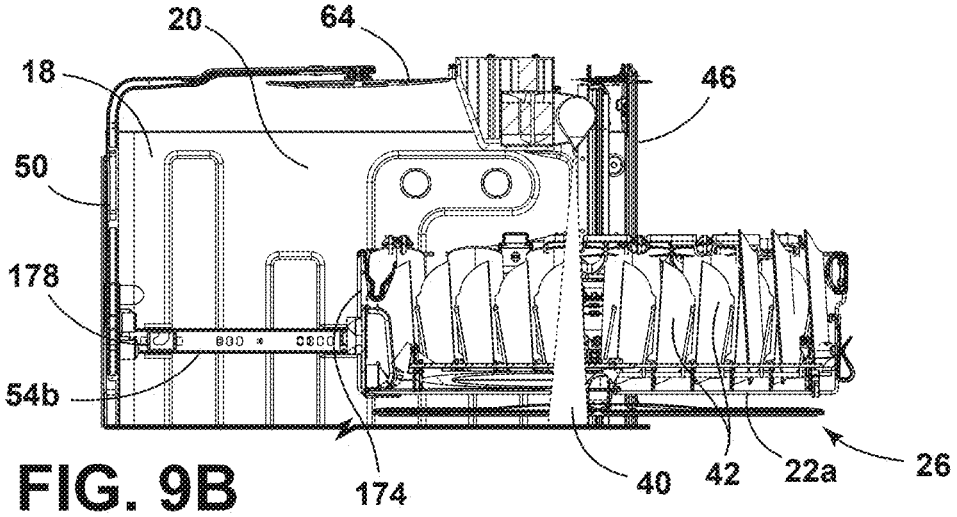
FIG. 9B is a partial cross-sectional view of a tub with an upper dishrack in a deployed state and with an air curtain illustrated directing air in a downward direction toward the upper dishrack, according to the present disclosure.
Figure 9C:
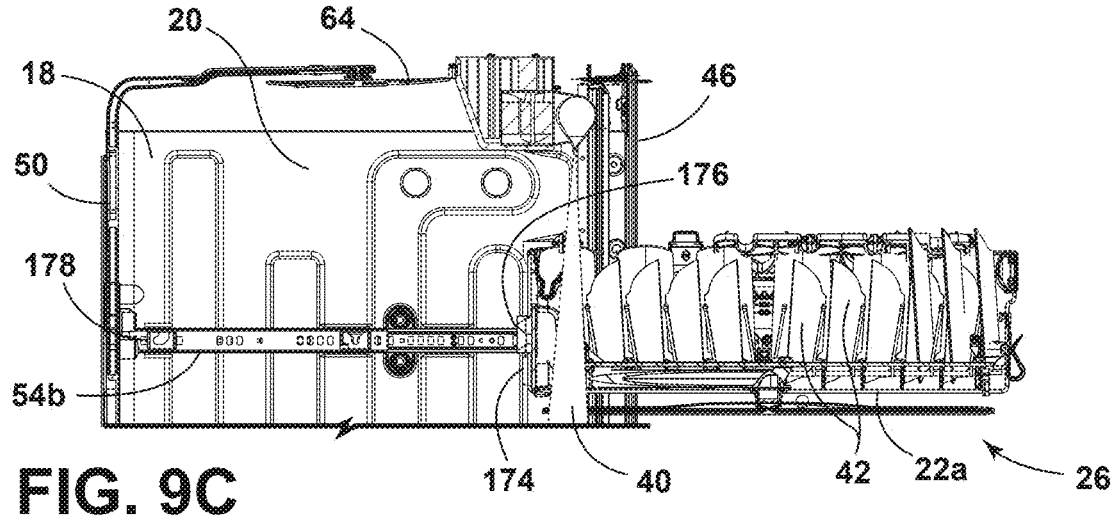
FIG. 9C is a partial cross-sectional view of a tub with an upper dishrack in a fully deployed state and with an air curtain illustrated directing air in a downward direction toward a rear end of the upper dishrack, according to the present disclosure.

Referring to FIGS. 9A-9C, when the air drying system 28 is activated, the blower 38 utilizes ambient air drawn from an exterior area outside of tub 12 (e.g., proximate to the external portion 96 of the housing 30) and directs the air through the air inlet 32. The blower 38 drives the air through the housing 30 and into the elongated body 116 of the air knife 34. The air directed by the blower 38 provides a high-pressure, high-velocity air supply that is forced through the air outlet 36 of the air knife 34. As the blower 38 continuously draws air into the air inlet 32 and through the air outlet 36 providing the continuous stream of air forming the air curtain 40, the user can move the upper dishrack 22*a* between the stowed state 24 and the deployed state 26 to reduce liquid and moisture on the dishes 42. Due to the dry assist cycle being performed after other drying cycles of the dishwasher 10, the dry assist cycle may be more efficient in removing additional liquid and moisture from the dishes 42.

When the user opens the door 58, the upper dishrack 22*a* is in the stowed state 24. The user can grasp the upper dishrack 22*a* and move the upper dishrack 22*a* out of the washing chamber 20. As the user continues to draw or move the upper dishrack 22*a* outward relative to the front opening 46 along the guide members 54*a*, 54*b*, the air curtain 40 directs the pressurized air supply downwardly along a substantial depth of the upper dishrack 22*a* and onto the dishes 42. The user can continue to move the upper dishrack 22*a* to the deployed state 26 until a rear end 174 of the upper dishrack 22*a* meets a front end 176 of the guide members 54*a*, 54*b* (e.g., when the upper dishrack 22*a* is fully deployed). The user may deactivate the air drying system 28 via the user interface 78 when desired, however, the user may allow for the air drying system 28 to remain active.

As the air drying system 28 remains active, the user can direct the upper dishrack 22*a* into the washing chamber 20, toward the stowed state 24. The air curtain 40 continues to direct the pressurized air supply downwardly and onto the dishes 42, allowing multiple paths through the air curtain 40. The user can continue to move the upper dishrack 22*a* toward the stowed state 24 until the rear end 174 of the upper dishrack 22*a* meets a rear end 178 of the guide members 54*a*, 54*b* (e.g. when the upper dishrack 22*a* is fully stowed). The user may adjust the upper dishrack 22*a* between the fully stowed state 24 and the fully deployed state 26 any number of times or until the excess liquid and moisture are reduced from the dishes 42.

The high velocity of the air from the air curtain 40 assists in the efficient removal of pools of liquid and moisture that are generally common on dishes 42, especially those with deep recesses, after the dishwashing process is complete. The air velocity of air being toward the dishes 42 in the air curtain 40 is greater than about 5 m/s, such as between approximately 5 m/s and approximately 12 m/s, to provide for effective removal of the excess liquid or moisture from the dishes 42. In certain non-limiting aspects, the air velocity may be between approximately 8 m/s and approximately 10 m/s to maximize efficiency of the removal of the excess liquid or moisture from the dishes 42.

During the drying cycle of the dishwashing process, liquid and moisture are removed from the dishes 42, however, residual pools of liquid may remain on the dishes 42, such as in deep recesses of specific dishes 42 or types of dishes 42. The pressurized and localized air velocity of the air curtain 40 directed towards the deep recesses of dishes 42 during the dry assist cycle assists in the reduction or removal of the residual pools of liquid within the deep recesses. The selected or desired air velocity of between about 5 m/s and about 12 m/s can be maintained up to a distance of approximately 250 mm from the air outlet 36 (i.e. the nozzle) for effective removal of the excess liquid or moisture from the dishes 42. In this way, the air velocity may be maintained from the air outlet 36 to the dishes 42 and/or the dishrack 22*a* up to approximately 250 mm, or farther, for providing an efficient air curtain 40 to achieve liquid reduction or removal from the dishes 42.

Figure 10:
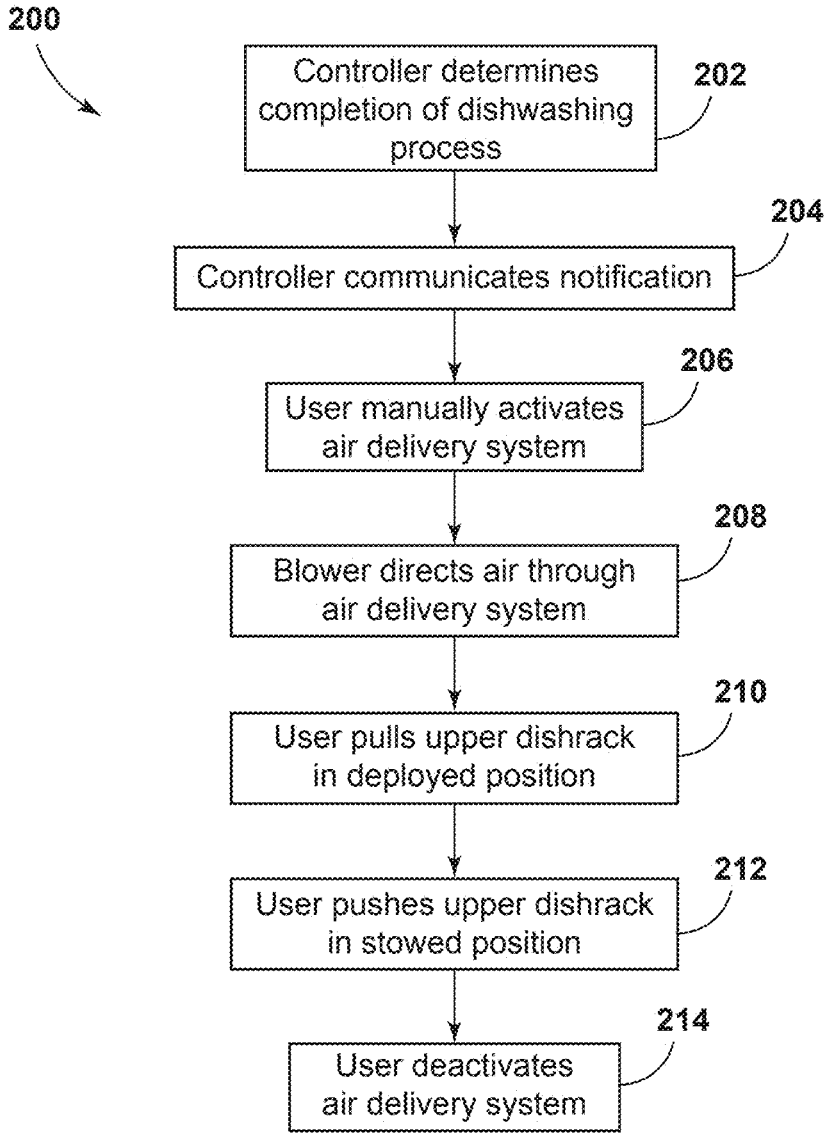
FIG. 10 is a flow diagram of a method of manually operating an air drying system of a dishwashing appliance, according to the present disclosure.

With reference to FIG. 10, as well as FIGS. 1-9C, a first method 200 of operating the air drying system 28 of the dishwasher 10 through manual activation includes step 202, where the controller 74 of the dishwasher 10 determines the dishwashing process is completed. This determination can be based on the stored routines 170. In step 204, the controller 74 generates and communicates the notification to the user, indicating that the selection of the dry assist cycle is available and the dishwashing process is completed. In step 206, the user initiates the activation of the air drying system 28 by manually selecting the dry assist cycle via the user interface 78.

In step 208, the blower 38 is activated and directs air through the air inlet 32, through the central opening 120 of the air knife 34, and through the elongated body 116 of the air knife 34. The blower 38 generates forced air that is directed from the elongated body 116 through the air outlet 36 of the air knife 34 as the air curtain 40. The air curtain 40 forms a fixed, fan-shaped sheet of air through which the upper dishrack 22*a* is moved when in the deployed state 26.

In step 210, the user opens the door 58 of the dishwasher 10 and pulls the upper dishrack 22*a* outwardly along the upper guide members 54*a*, 54*b*. As the upper dishrack 22*a* moves through the front opening 46, the dishrack 22*a* is also moved through the air curtain 40 such that the pressurized airflow of the air curtain 40 is directed downwardly towards the dishes 42 thereby reducing or removing excess liquid and moisture on the dishes 42 disposed in the upper dishrack 22*a*. The user can continue to move the upper dishrack 22*a* outwardly as the air curtain 40 directs air downwardly on the dishes 42 along a substantial depth of the upper dishrack 22*a* until the rear end 174 of the upper dishrack 22*a* meets the front end 176 of the guide members 54*a*, 54*b*.

In step 212, the user pushes the upper dishrack 22*a* inwardly along the guide members 54*a*, 54*b*, into the washing chamber 20 of the tub 12. As the upper dishrack 22*a* is moved back into the washing chamber 20, the dishrack 22*a* again moves through the air curtain 40 for the continuous, pressurized airflow of the air curtain 40 to be directed downwardly towards the dishes 42 thereby continuing the reduction and removal of liquid and moisture on the dishes 42 disposed in the upper dishrack 22*a*. The user can continue to move the upper dishrack 22*a* inwardly as the air curtain 40 directs air downwardly on the dishes 42 along a substantial depth of the upper dishrack 22*a* relative to the washing chamber 20, until the rear end 174 of the upper dishrack 22*a* meets the rear end 178 of the guide members 54*a*, 54*b* when the upper dishrack 22*a* is in the stowed state 24. The combination of step 210 and step 212 results in the dishes 42 moving across the air curtain 40 twice, however, the user may move the dishes 42 across the air curtain 40 as often as needed. In step 214, the user may deactivate the air drying system 28 via the user interface 78. The steps 202-214 of method 200 may be performed in any order, simultaneously, in sequence, omitted, repeated, etc. without departing from the teachings herein.

Figure 11:
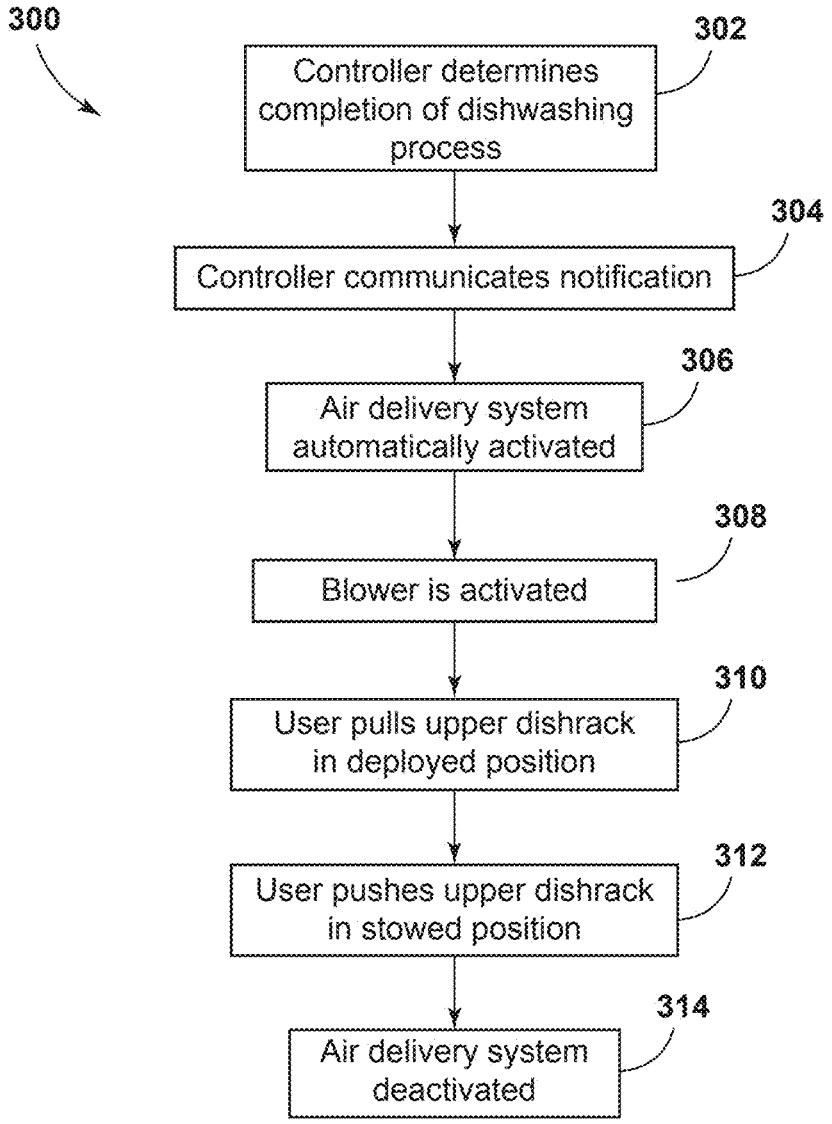
FIG. 11 is a flow diagram of a method of automatically operating an air drying system of a dishwashing appliance, according to the present disclosure.

With reference to FIG. 11, as well as FIGS. 1-9C, a second method 300 of operating the air drying system 28 of the dishwasher 10 with automatic activation includes step 302, where the controller 74 of the dishwasher 10 determines the dishwashing process is complete, which may be based on the stored routines 170. In step 304, the controller 74 generates and communicates the notification to the user indicating the activation of the blower 38 upon initiation of the dry assist cycle. In step 306, the activation of the air drying system 28 is automatically initiated upon the user opening the door 58.

In step 308, when the door 58 is in the opened position, the blower 38 is activated and directs air through the air inlet 32, through the central opening 120 of the air knife 34, and through the elongated body 116 of the air knife 34. The blower 38 generates forced air that is directed from the elongated body 116 through the air outlet 36 of the air knife 34 as the air curtain 40. When in the deployed state, the upper dishrack 22*a* is moved across or through the air curtain 40, with the air curtain 40 forming a fixed, fan-shaped sheet of air.

In step 310, the user opens the door 58 of the dishwasher 10 and pulls the upper dishrack 22*a* outwardly along the guide members 54*a*, 54*b*. As the upper dishrack 22*a* moves through the front opening 46, the dishrack 22*a* is also moved through the air curtain 40 such that the pressurized airflow of the air curtain 40 is directed downwardly towards the dishes 42 thereby reducing or removing liquid and moisture on the dishes 42 disposed in the upper dishrack 22*a*. The user can continue to move the upper dishrack 22*a* outwardly as the air curtain 40 directs air downwardly on the dishes 42 along a substantial depth of the upper dishrack 22*a* until the rear end 174 of the upper dishrack 22*a* meets the front end 176 of the guide members 54*a*, 54*b*.

In step 312, the user pushes the upper dishrack 22*a* inwardly along the guide members 54*a*, 54*b* into the washing chamber 20 of the tub 12. As the upper dishrack 22*a* is moved back into the washing chamber 20, the dishrack 22*a* again moves through the air curtain 40 for the continuous, pressurized airflow of the air curtain 40 to be directed downwardly towards the dishes 42 thereby continuing the reduction and removal of liquid and moisture on the dishes 42 disposed in the upper dishrack 22*a*. The user can continue to move the upper dishrack 22*a* inwardly as the air curtain 40 directs air downwardly on the dishes 42 along a substantial depth of the upper dishrack 22*a* relative to the washing chamber 20, until the rear end 174 of the upper dishrack 22*a* meets the rear end 178 of the guide members 54*a*, 54*b* when the upper dishrack 22*a* is in the stowed state 24. The combination of step 310 and step 312 results in the dishes 42 moving across the air curtain 40 twice, however, the user may move the dishes 42 across the air curtain 40 as often as needed.

In step 314, the air drying system 28 is deactivated and the drying assembly process is complete. The air drying system 28 may be deactivated after a predefined amount of time, stored programs (e.g., routines 170), based on a position of the upper dishrack 22*a*, based on a position of the door 58, etc. The steps 302-314 of method 300 may be performed in any order, simultaneously, in sequence, omitted, repeated, etc. without departing from the teachings herein. It will be understood that any described processes or steps 202-214, 302-314 within described processes and methods 200, 300 may be combined with other disclosed processes or steps to form structures or functions within the scope of the present disclosure. The exemplary structures and processes disclosed herein are for illustrative purposes and are not to be construed as limiting.

Use of the present assembly may provide for a variety of advantages. For example, the air knife 34 of the air drying system 28 may provide a pressurized fan-shaped jet of air in the form of the air curtain 40 from the air outlet 36. Additionally, the air curtain 40 is directed in the downward direction across the substantial or full width of the upper dishrack 22*a* to remove excess liquid and moisture from the dishes 42, for example, from the recesses of dishes 42 that tend to pool excess liquid in the form of puddles. Additionally, air may flow through the dishes 42 on the upper dishrack 22*a* and assist with removing liquid or moisture from the lower dishrack 22*b*. As the user moves the upper dishrack 22*a* from the stowed state 24 to the deployed state 26, the vibration and slight movement of the upper dishrack 22*a* may assist in the removal and reduction of excess moisture and liquid on the dishes 42.

Further, the elongated body 116 of the air knife 34 is generally a "teardrop" shape that includes a rounded portion and a narrow portion, where the rounded portion of the elongated body 116 assists in reducing internal turbulence of air to provide a uniform and consistent stream of air via the air outlet 36 and the narrow portion of the elongated body 116 includes the slit 26 that forms the air outlet 36. Additionally, the slit 26 generally forms a nozzle-like opening that assists in forming the air curtain 40 in a downward direction towards the dishes 42 of the upper dishrack 22*a*. Additionally, the elongated body 116 of the air knife 34 is tilted inwardly towards the washing chamber 20 between about 2° and about 3° to assist in retaining excess moisture and liquid within the washing chamber 20 when the air curtain 40 is directing pressurized air along the dishes 42 when the air drying system 28 is activated (see FIG. 6). In certain aspects, the slit 126 of the elongated body 116 of the air knife 34 is configured to tilt inwardly towards the washing chamber 20 between about 2° and about 3° to assist in excess moisture and liquid retention when the air drying system 28 is activated. Further, the blower 38 is located central to a front portion of the top wall 14 of the tub 12. Moreover, the internal portion 98 of the housing 30 tapers to assist in directing the air through the air drying system 28. Further, the tapered walls of the housing 30 assist in reducing the space the housing 30 extends into the washing chamber 20 to prevent or reduce impingement of any functions of the dishwasher 10. Additional benefits and advantages may be realized and/or achieved.

The device disclosed herein is further summarized in the following paragraphs and is further characterized by combinations of any and all of the various aspects described therein.

According to one aspect of the present disclosure, a dishwasher includes a tub having a top wall that extends between first and second opposing side walls. The tub defines a washing chamber. Guide members are coupled to the first and second opposing side walls of the tub. A dishrack is supported by the guide members, wherein the dishrack is operable between a stowed state within the washing chamber and a deployed state at least partially extending out of the washing chamber. An air drying system is coupled to the tub. The air drying system includes a housing that defines an air inlet. The housing is coupled to the top wall of the tub and extends into the washing chamber proximate to the dishrack. An air knife is coupled to the housing and extends along a width of the washing chamber proximate to the top wall. The air knife defines a central opening and an air outlet. A blower is disposed in the housing. The blower is configured to direct air through the air outlet of the air knife to generate an air curtain across the width of the washing chamber. The dishrack is configured to move through the air curtain as the upper dishrack moves between the stowed state and the deployed state to reduce liquid on dishes on the dishrack. The air curtain is angled toward an interior of the washing chamber.

According to another aspect of the present disclosure, an air knife includes an elongated body that has opposing rounded ends. The opposing rounded ends are configured to enclose an internal air passage of the air knife and assist in the formation of an air curtain.

According to another aspect of the present disclosure, an elongated body of an air knife defines a teardrop geometry that is configured to assist in transferring air from an internal passage through an air outlet.

According to another aspect of the present disclosure, a central opening of an air knife is centrally located along an elongated body. The central opening is in fluid communication with a blower.

According to another aspect of the present disclosure, a controller is configured to output a notification indicating a completion of a dishwashing process. The controller is configured to initiate a dry assist cycle upon completion of the dishwashing process.

According to another aspect of the present disclosure, a top wall of a tub defines an opening, the opening being centrally located along a front portion of the top wall of the tub.

According to another aspect of the present disclosure, a housing is disposed in the opening of a tub. The housing extends through a top wall of the tub via the opening and into a washing chamber.

According to another aspect of the present disclosure, a dishwasher includes a tub having a top wall. The tub defines a front opening and a washing chamber. A dishrack is disposed in the washing chamber. The dishrack is operable between a stowed state and a deployed state. A drying assembly is coupled to the housing. The drying assembly includes a housing that is coupled to the top wall of the tub. The housing includes an internal portion within the washing chamber and an external portion outside of the washing chamber. An air knife coupled to the housing. The air knife includes an air outlet. A blower is configured to direct air through the air knife to form a fan-shaped air curtain that is directed toward a bottom of the washing chamber as the dishrack moves between the stowed and deployed states.

According to another aspect of the present disclosure, an air drying system includes a cover coupled to an external portion of a housing. The cover partially overlays an interior cavity of the housing to define an air inlet.

According to another aspect of the present disclosure, an area of the air inlet is greater than the diameter of the blower to reduce obstruction of airflow through the air drying system.

According to another aspect of the present disclosure, an air knife extends across a width of a washing chamber, and wherein the air knife defines a slit across the width of the washing chamber to form an air outlet.

According to another aspect of the present disclosure, a slit is angled toward a rear wall of a tub to direct an air curtain inwardly towards a washing chamber.

According to another aspect of the present disclosure, an air knife extends in opposing directions from a blower along a width of a washing chamber from the blower and proximate a front opening.

According to another aspect of the present disclosure, an air knife includes opposing ends that are rounded to promote smooth airflow through the air knife and through an air outlet.

According to another aspect of the present disclosure, air forming an air curtain that moves at a velocity between 5 m/s and 12 m/s at a distance of between 200 mm and 250 mm from an air outlet.

According to yet another aspect, a dishwasher includes a tub having a top wall extending between opposing side walls. The tub defines a washing chamber. A dishrack is operable between a stowed state within the washing chamber and a deployed state that extends at least partially out of the washing chamber. An air drying system is coupled to the tub. The air drying system includes a housing coupled to the top wall of the tub and extends into the washing chamber proximate to the dishrack. The housing defines an air inlet. An air knife is coupled to the housing and extends along a width of the washing chamber proximate to the top wall of the tub. The air knife defines a slit. A blower is operably coupled to the air knife. The blower is configured to draw air through the air inlet and direct the air through the slit of the air knife to generate an air curtain across the width of the washing chamber.

According to another aspect of the present disclosure, a dishrack is configured to move through an air curtain as the dishrack moves between a stowed state and a deployed state to reduce moisture from dishes that are disposed in the dishrack.

According to another aspect of the present disclosure, a user interface and a controller communicatively coupled to the user interface. The controller is configured to initiate a drying system by activating a blower in response to interaction with the user interface.

According to another aspect of the present disclosure, a housing of an air drying system includes a cover that is configured to partially overlay an interior cavity of the housing to define an air inlet.

According to another aspect of the present disclosure, a blower that is configured to direct air from an area exterior to a washing chamber and through a slit to form an air curtain.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

What is claimed is:

1. A dishwasher, comprising:

a tub having a top wall extending between first and second opposing side walls, wherein the tub defines a washing chamber;

guide members coupled to the first and second opposing side walls of the tub, respectively;

a dishrack supported by the guide members, wherein the dishrack is operable between a stowed state within the washing chamber and a deployed state at least partially extending out of the washing chamber; and an air drying system coupled to the tub, the air drying system including:

a housing defining an air inlet, wherein the housing is coupled to the top wall of the tub and extends into the washing chamber proximate the dishrack;

an air knife coupled to the housing and extending along a width of the washing chamber proximate to the top wall, the air knife defining a central opening and an air outlet; and a blower disposed in the housing, wherein the blower is configured to direct air through the air outlet of the air knife to generate an air curtain across the width of the washing chamber, and wherein the dishrack is configured to move through the air curtain as the dishrack moves between the stowed state and the deployed state to reduce liquid on dishes on the dishrack, and further wherein the air curtain is angled toward an interior of the washing chamber.

2. The dishwasher of claim 1, wherein the air knife includes an elongated body having opposing rounded ends configured to enclose an internal air passage of the air knife and assist forming the air curtain.

3. The dishwasher of claim 2, wherein the elongated body of the air knife defines a teardrop geometry configured to assist in transferring air from the internal air passage through the air outlet.

4. The dishwasher of claim 2, wherein the central opening of the air knife is centrally located along the elongated body, and wherein the central opening is in fluid communication with the blower.

5. The dishwasher of claim 1, further comprising:

a controller configured to output a notification indicating a completion of a dishwashing process, wherein the controller is configured to initiate a dry assist cycle upon completion of the dishwashing process.

6. The dishwasher of claim 1, wherein the top wall of the tub defines an opening, the opening being centrally located along a front portion of the top wall of the tub.

7. The dishwasher of claim 6, wherein the housing is disposed in the opening of the tub, and wherein the housing extends through the top wall of the tub via the opening and into the washing chamber.

8. A dishwasher, comprising:

a tub having a top wall, wherein the tub defines a front opening and a washing chamber;

a dishrack disposed in the washing chamber, wherein the dishrack is operable between a stowed state and a deployed state; and an air drying system coupled to the tub, the air drying system including:

a housing coupled to the top wall of the tub, wherein the housing includes an internal portion within the washing chamber and an external portion outside of the washing chamber;

an air knife coupled to the housing, wherein the air knife includes an air outlet; and a blower configured to direct air through the air knife to form a fan-shaped air curtain that is directed toward a bottom of the washing chamber as the dishrack moves between the stowed and deployed states.

9. The dishwasher of claim 8, wherein the air drying system includes:

a cover coupled to the external portion of the housing, wherein the cover partially overlays an interior cavity of the housing to define an air inlet.

10. The dishwasher of claim 9, wherein an area of the air inlet is greater than a diameter of the blower to reduce obstruction of airflow through the air drying system.

11. The dishwasher of claim 8, wherein the air knife extends across a width of the washing chamber, and wherein the air knife defines a slit across the width of the washing chamber to form the air outlet.

12. The dishwasher of claim 11, wherein the slit is angled toward a rear wall of the tub to direct the fan-shaped air curtain inwardly towards the washing chamber.

13. The dishwasher of claim 11 wherein the air knife extends in opposing directions from the blower along the width of the washing chamber and proximate the front opening.

14. The dishwasher of claim 8, wherein the air knife includes opposing ends that are rounded to promote smooth airflow through the air knife and through the air outlet.

15. The dishwasher of claim 8, wherein air forming the fan-shaped air curtain moves at a velocity between 5 m/s and 12 m/s at a distance of between 200 mm and 250 mm from the air outlet.

16. A dishwasher, comprising:

a tub having a top wall extending between opposing side walls, wherein the tub defines a washing chamber;

a dishrack operable between a stowed state within the washing chamber and a deployed state extending at least partially out of the washing chamber; and an air drying system coupled to the tub, the air drying system including:

a housing coupled to the top wall of the tub and extending into the washing chamber proximate the dishrack, the housing defining an air inlet;

an air knife coupled to the housing and extending along a width of the washing chamber proximate to the top wall of the tub, wherein the air knife defines a slit; and a blower operably coupled to the air knife, wherein the blower is configured to draw air through the air inlet and direct the air through the slit of the air knife to generate an air curtain across the width of the washing chamber.

17. The dishwasher of claim 16, wherein the dishrack is configured to move through the air curtain as the dishrack moves between the stowed state and the deployed state to reduce moisture from dishes disposed in the dishrack.

18. The dishwasher of claim 16, further comprising:

a user interface; and a controller communicatively coupled to the user interface, wherein the controller is configured to initiate the air drying system by activating the blower in response to interaction with the user interface.

19. The dishwasher of claim 16, wherein the housing of the air drying system includes a cover configured to partially overlay an interior cavity of the housing to define the air inlet.

20. The dishwasher of claim 19, wherein the blower is configured to direct air from an area exterior to the washing chamber and through the slit to form the air curtain.

* * * * *